US008126345B2

(12) United States Patent
Handa et al.

(10) Patent No.: US 8,126,345 B2
(45) Date of Patent: Feb. 28, 2012

(54) IMAGE FORMING DEVICE

(75) Inventors: Hiroshi Handa, Inazawa (JP); Hiroki Mori, Nagoya (JP); Masatoshi Shiraki, Nagoya (JP); Yukimasa Yoshida, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/971,516

(22) Filed: Dec. 17, 2010

(65) Prior Publication Data

US 2011/0085811 A1 Apr. 14, 2011

Related U.S. Application Data

(63) Continuation of application No. 12/390,791, filed on Feb. 23, 2009, now Pat. No. 7,885,564.

(30) Foreign Application Priority Data

Mar. 7, 2008 (JP) ..... 2008-058009
Feb. 18, 2009 (JP) ..... 2009-034776

(51) Int. Cl.
*G03G 15/06* (2006.01)
*G03G 15/08* (2006.01)

(52) U.S. Cl. ..... 399/55; 399/281

(58) Field of Classification Search ..... 399/53, 399/55, 281, 285; 347/140
See application file for complete search history.

(56) References Cited

U.S. PATENT DOCUMENTS 5,774,762 A * 6/1998 Takemoto et al. ..... 399/55 X
5,839,021 A 11/1998 Hayashi et al.
5,978,635 A 11/1999 Azuma et al.
6,134,397 A 10/2000 Shimazaki et al.
6,415,114 B1 * 7/2002 Nakazato et al. ..... 399/53 X
7,035,561 B2 4/2006 Onishi

FOREIGN PATENT DOCUMENTS

JP 07-005765 1/1995

* cited by examiner

*Primary Examiner* — Sandra Brase
(74) *Attorney, Agent, or Firm* — Banner & Witcoff, Ltd.

(57) ABSTRACT

An image-forming device can include an image acquiring unit that acquires image data, an image forming unit that forms an image based on the image data, a determining unit that determines whether the image data includes a part having density greater than or equal to a prescribed density, and a controller. The image forming unit can include a developing roller, a supply roller for supplying developer to the developing roller, and a bias applying unit that applies first and second voltages between the developing roller and the supply roller in first and second modes, respectively. The controller can control the bias applying unit to apply one of the first and second voltages when the determining unit determines whether the image data includes the part having density greater than or equal to a prescribed density.

10 Claims, 13 Drawing Sheets

FIG.12

| Tup | | Tdown | |
|---|---|---|---|
| Rp | V | Rp | V |
| 0 | 0 | 0 | 0 |
| 1 | 0 | 1 | 100 |
| 2 | 100 | 2 | 200 |
| 3 | 200 | 3 | 300 |
| 4 | 300 | 4 | 400 |
| 5 | 400 | 5 | 500 |
| 6 | 500 | 6 | 600 |
| 7 | 600 | 7 | 700 |
| 8 | 700 | 8 | 700 |
| 9 | 700 | 9 | 700 |

IMAGE FORMING DEVICE

CROSS REFERENCE TO RELATED APPLICATION

This application is a continuation of prior U.S. application Ser. No. 12/390,791, filed Feb. 23, 2009, which claims priority from Japanese Patent Applications No. 2008-058009 filed Mar. 7, 2008, and No. 2009-034776 filed Feb. 18, 2009. The entire content of each of these priority applications is incorporated herein by reference.

TECHNICAL FIELD

The present invention relates to an image forming device, an image forming method, and a computer-readable recording medium.

BACKGROUND

A conventional developing device incorporated in an electrophotographic image forming apparatus includes a developing roller and a supply roller. The developing roller supplies a developer to the photosensitive body. The supply roller supplies the developer to the developing roller. The developer moves in accordance with a voltage between supply roller and developing roller. Therefore, in order to move the developer from the supply roller to the developing roller, a predetermined voltage is set between the developing roller and the supply roller corresponding to type of the apparatus and a developer used in the apparatus.

If the image forming apparatus has been used for a long time, the image density may decrease with time. In view of this, the apparatus disclosed in Japanese unexamined patent application publication No. HEI 07-005765 changes a voltage between the developing roller and the supply roller in accordance with a remaining amount of the developer.

The image density decreases not only due to temporal change, but also due to a characteristic of image to be printed. If the image has a high-density, such as a black image, the developer needs to move in large amount from the developing roller to the photosensitive body. In some cases, the developer may not be supplied from the supply roller to the developing roller in a sufficient amount, inevitably lowering the image density. Even if image data is a specific pattern having low density, the uneven density may be conspicuous in the specific pattern. This uneven density may be insufficiently recognized as uneven printing when the developer is supplied insufficiently.

If the developer used is a non-magnetic two-component developer, strongly-charged component is more consumed than weakly-charged component, as the voltage is kept applied at a high voltage. This phenomenon is so-called "selective development." Consequently, a ratio of the weakly-charged component to the strongly-charged component will increase, as the developer is consumed. Finally, images can no longer be developed even if the bias applied is increased.

SUMMARY

In view of the foregoing, it is an object of the invention to provide an image forming device that can suppress a decrease in image density in printing an image at a high density.

In order to attain the above and other objects, the invention provides an image-forming device including an image acquiring unit, an image forming unit, a determining unit, and a controller. The image acquiring unit acquires image data for one page. The image forming unit forms an image based on the image data. The image forming unit includes a developing roller, a supply roller, and a bias applying unit. The developing roller carries a developer. The supply roller supplies the developer to the developing roller. The bias applying unit applies a first voltage between the developing roller and the supply roller in a first mode, and applies a second voltage between the developing roller and the supply roller in a second mode. The determining unit determines whether the image data includes a part having density greater than or equal to a prescribed density. The controller controls the bias applying unit to apply the first voltage when the determining unit determines that the image data does not include the part having density greater than or equal to a prescribed density, and to apply the second voltage when the determining unit determines that the image data includes the part having density greater than or equal to a prescribed density. The developer is more readily supplied from the supply roller to the developing roller when the bias applying unit applies the second voltage than when bias applying unit applies the first voltage.

According to another aspect, the present invention provides an image forming method including: acquiring image data for one page; determining whether the image data includes a part having density greater than or equal to a prescribed density; and controlling a bias applying unit to apply a first voltage between a developing roller and a supply roller when that the image data does not include the part having density greater than or equal to a prescribed density is determined in the determining step, and to apply a second voltage between the developing roller and the supply roller when that the image data includes the part having density greater than or equal to a prescribed density is determined in the determining step, the developing roller carrying a developer, the supply roller supplying the developer to the developing roller.

According to another aspect, the present invention provides a computer-readable recording medium that stores an image forming program, the image forming program comprising instructions for: acquiring image data for one page; determining whether the image data includes a part having density greater than or equal to a prescribed density; and controlling a bias applying unit to apply a first voltage between a developing roller and a supply roller when that the image data does not include the part having density greater than or equal to a prescribed density is determined in the determining step, and to apply a second voltage between the developing roller and the supply roller when that the image data includes the part having density greater than or equal to a prescribed density is determined in the determining step, the developing roller carrying a developer, the supply roller supplying the developer to the developing roller.

BRIEF DESCRIPTION OF THE DRAWINGS

The particular features and advantages of the invention as well as other objects will become apparent from the following description taken in connection with the accompanying drawings, in which:

FIG. 12 is a diagram showing an example of the data configuration of tables;

DETAILED DESCRIPTION

Figure 1:
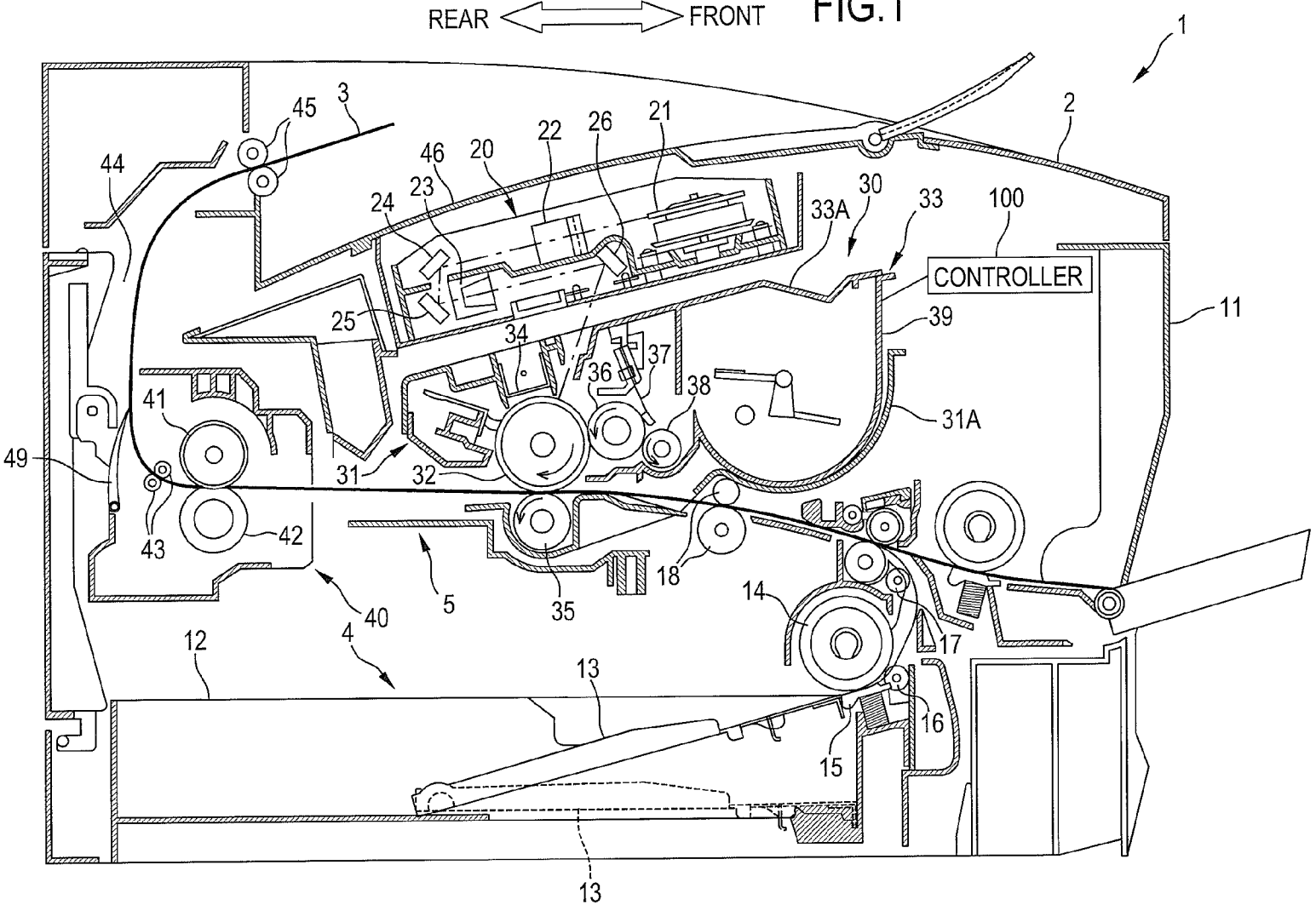
FIG. 1 is a sectional side view of an example of an image forming device according to a first embodiment of the present invention.

An image forming device according to embodiments of the invention will be described while referring to the accompanying drawings wherein like parts and components are designated by the same reference numerals to avoid duplicating description. FIG. 1 is a sectional side view of a color laser printer 1 as an example of image forming device according to a first embodiment.

As shown in FIG. 1, the laser printer 1 includes a main casing 2 and, within the main casing 2, a feeding unit 4 for supplying a recording sheet 3 such as a paper, an image forming unit 5 for forming images on the recording sheet 3 supplied by the feeding unit 4. In the front side wall of the main casing 2, a front cover 11 capable of opening and closing over is provided. When the front cover 11 is open, a process cartridge 30 described later is detachably mounted in the main casing 2.

The feeding unit 4 includes a sheet supply tray 12, a sheet pressing plate 13, a sheet supply roller 14, a sheet-supplying pad 15, paper dust removing rollers 16 and 17, and registration rollers 18. The sheet supply tray 12 is removably mounted on the bottom of the main casing 2. The sheet pressing plate 13 is provided in the sheet supply tray 12. The sheet supply roller 14 and the sheet supplying pad 15 are provided above front end of the sheet supply tray 12. The paper dust removing rollers 16 and 17 are disposed downstream of the sheet supply roller 14 in a supplying direction of recording sheets 3. The registration rollers 18 are provided downstream of the paper dust removing rollers 16 and 17 in the supply direction.

The sheet pressing plate 13 presses and conveys the recording sheets 3 stacked on the sheet supply tray 12 to the sheet supplying pad 15. The sheet supply roller 14 and the sheet supplying pad 15 feed the topmost of recording sheets 3 forwards, one by one. The recording sheets 3 passes over the rollers 16 to 18 to the image-forming unit 5.

The image forming unit 5 includes a scanning unit 20, the process cartridge 30, and a fixing unit 40. The scanning unit 20 is disposed in the top section of the main casing 2 and includes a laser light source (not shown), a polygon mirror 21 that can be driven to rotate, lenses 22 and 23, reflecting mirrors 24, 25, and 26, and the like. The laser light source emits a laser beam based on image data. As illustrated by a dotted line in FIG. 1, the laser beam is deflected by the polygon mirror 22, passes through the fθ lens 23, is reflected by the reflecting mirror 24, passes through the lens 25, and is reflected downward by the reflecting mirror 26 to be irradiated on the surface of the photosensitive drum 32 described later in the process cartridge 20.

The process cartridge 30 is detachably mounted in the main casing 2 beneath the scanning unit 20. Within the main casing 2, the process cartridge 30 is also provided with the photosensitive cartridge 31, a developing cartridge 33 as an example of a developing apparatus. The photosensitive cartridge 31 has a photosensitive body frame 31A that is a hollow outer frame.

The developing cartridge 33 is removably mounted to the photosensitive-body frame 31A. The developing cartridge 33 has a developing frame 33A that is a hollow outer frame, and includes a developing roller 36, a layer-thickness regulating blade 37, a supply roller 38, and a toner hopper 39. The developing roller 36 and supply roller 38 are supported by the developing frame 33A and can rotate around their axes. The toner hopper 39 holds toner that is used as developer. The toner is supplied to the developing roller 36 as the supply roller 38 rotates in the counterclockwise direction (in a direction shown by arrow in FIG. 1). The toner is positively charged by friction, between the developing roller 36 and the supply roller 38. The toner supplied to the developing roller 36 enters a gap between the developing roller 36 and the layer-thickness regulating blade 37 as the developing roller 36 rotates in the counterclockwise direction (in a direction shown by arrow in FIG. 1). The toner is carried on the developing roller 36, in the form of a thin layer having a prescribed thickness. In the first embodiment, the developing roller 36 and the supply roller 38 are applied with voltages based on a supply bias mode, as will be described later.

The photosensitive cartridge 31 includes a photosensitive drum 32, a scorotron-type charger 34, and a transfer roller 35. The photosensitive drum 32 is supported by the photosensitive-body frame 31A. The photosensitive drum 32 can rotate in the clockwise direction (in a direction shown by arrow in FIG. 1). The photosensitive drum 32 is connected to the ground and has a positively charged photosensitive layer on the circumferential surface of the photosensitive drum 32.

The charger 34 is disposed in opposition to but separates a prescribed distance from the photosensitive drum 32 so as not to contact the same. The charger 34 is configured of a positively charging Scorotron charger that generates a corona discharge from a wire formed of tungsten or the like, and can form a uniform charge of positive polarity over the surface of photosensitive drum 32.

The transfer roller 35 is rotatably supported on the photosensitive-body frame 31A and opposes and contacts the photosensitive drum 32 in a vertical direction from the bottom of the photosensitive drum 32. The transfer roller 35 is configured of a metal roller shaft that is covered with a roller formed of a conductive rubber material. During a transfer operation, a transfer bias is applied to the transfer roller 35. The transfer roller 35 is driven to rotate in a direction opposite the rotational direction of the photosensitive drum 32 by a motive force inputted from a motor (not shown), as shown in FIG. 1.

As the photosensitive drum 32 rotates, the charger 34 charges the surface of photosensitive drum 32 with a uniform positive polarity. Subsequently, a laser beam emitted from the scanning unit 20 is scanned at a high speed over the surface of photosensitive drum 32, forming an electrostatic latent image corresponding to an image to be formed on the recording sheet 3. Next, positively charged toner carried on the surface of developing roller 36 is transferred from the photosensitive drum 32 in contact with that when the developing roller 36 rotates, to areas on the surface of positively charged photosensitive drum 32 that were exposed to the laser beam and, therefore, have a lower potential. In this way, the latent image on the photosensitive drum 32 is transformed into a visible image according to a reverse developing process so that a toner image is carried on the surface of photosensitive drum 32.

Thereafter, after the registration rollers 18 rotates and conveys the recording sheet 3 through a transfer position between the photosensitive drum 32 and transfer roller 35, the toner image carried on the surface of the photosensitive drum 32 is transferred onto the recording sheet 3.

The fixing unit 40 is disposed on the rear side of the process cartridge 30 (downstream in the conveying direction of recording sheet 3). The fixing unit 40 includes a heating roller 41, a pressure roller 42, and a pair of conveying rollers 43, and a flapper 49. The pressure roller 42 is disposed below and in opposition to the heating roller 41 and cooperates with the heating roller 41 to nip the recording sheet 3. The conveying rollers 43 are provided on the rear side of the heating roller 41 and pressure roller 42.

The fixing unit 40 fixes the toner transferred onto the recording sheet 3 at the transfer position, to the recording sheet 3 by heat, when the recording sheet 3 passes between the heating roller 41 and pressure roller 42. After the toner is fixed to the recording sheet 3, the conveying roller 43 and flapper 49 convey the recording sheet 3 along a discharge path 44 that leads upward toward the top surface of main casing 2.

The laser printer 1 further includes discharger rollers 45 at the top of discharge path 44, and a discharge tray 46 formed on the top surface of the main casing 2. The discharger rollers 45 receive the recording sheet 3 conveyed along the discharge path 44 and discharge the recording sheet 3 onto the discharge tray 46.

Figure 2:
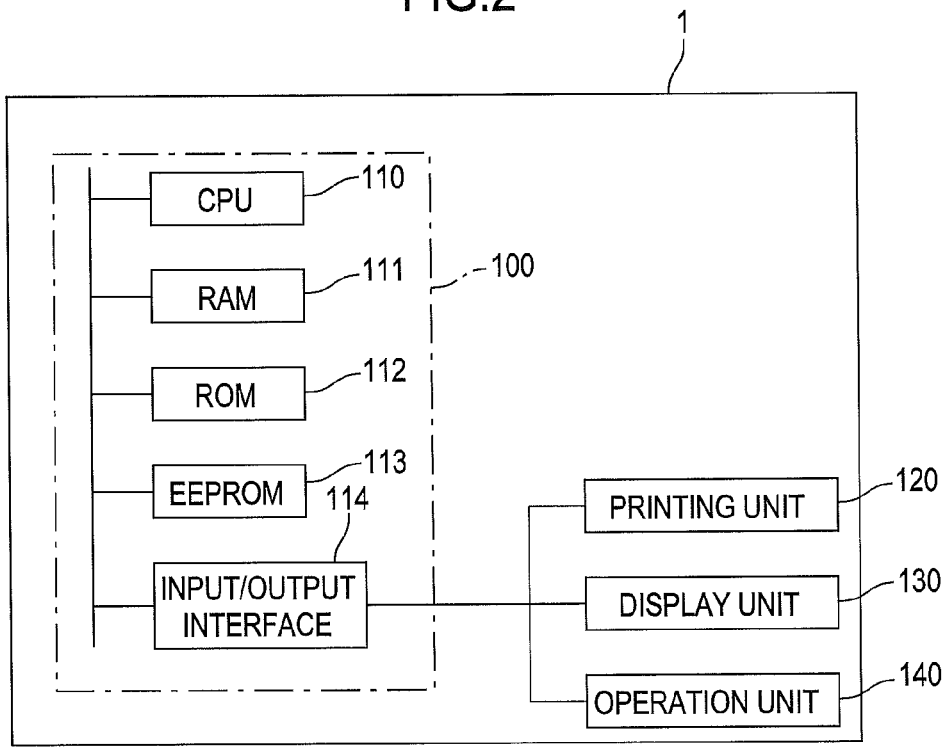
FIG. 2 is a block diagram of configuration of the image forming device.

As shown in FIG. 2, the laser printer 1 has a controller 100, a printing unit 120, a display unit 130, and an operation unit 140. The printing unit 120 includes mainly the image forming unit 5. The display unit 130 is, for example, a liquid crystal display panel that can display images. The operation unit 140 is, for example, an operation panel that the user may operate to input instructions.

The controller 100 includes a CPU 110, a RAM 111, a ROM 112, an EEPROM 113, and an input/output interface 114. The CPU 110 executes the various programs stored in the ROM 112 and EEPROM 113, thereby to perform various functions, which will be described below.

Figure 3:
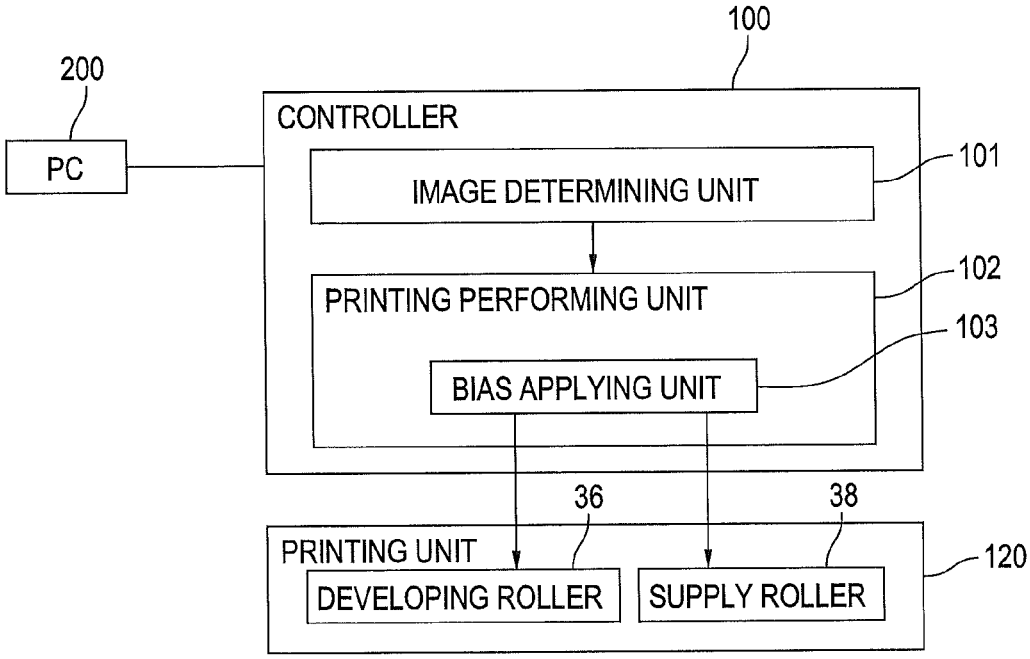
FIG. 3 is a block diagram explaining how a controller in the image forming device and a PC perform a printing process.

Next, how to print image will be described with reference to FIG. 3. As shown in FIG. 3, the controller 100 has an image determining unit 101 and a printing performing unit 102. The printing performing unit 102 includes a bias applying unit 103 for applying voltages to the developing roller 36 and supply roller 38, the voltages according with a condition of image data described later.

The controller 100 receives a print job from an apparatus for instructing printing, such as a personal computer (PC) 200. Note that the print job is data that includes image data and a print instruction. The controller 100 controls the printing unit 120 to form an image on the recording sheet 3, in accordance with the print job.

The image determining unit 101 determines, based on the print job acquired from the PC 200, whether a ratio of pixels at a prescribed area in one-page print image is greater than or equal to a prescribed value. The prescribed area is an area having a preset length in the sub-scanning direction of the image data. The image determining unit 101 outputs the decision to the printing performing unit 102. A method for making this decision will be explained later.

The printing performing unit 102 forms an image on the recording sheet 3 in accordance with the decision made by the image determining unit 101. More specifically, if the image determining unit 101 determines that a ratio of pixels to at a prescribed area is smaller than the preset ratio, the printing performing unit 102 forms an image in a first supply bias mode. In the first supply bias mode, a first voltage is applied between the developing roller 36 and the supply roller 38. If the image determining unit 101 determines that a ratio of pixels at a prescribed area is greater than or equal to the preset ratio, the printing performing unit 102 forms an image in a second supply bias mode. In the second supply bias mode, a second voltage between the developing roller 36 and the supply roller 38 is applied. In the second supply bias mode, the toner is more readily moved from the supply roller 38 to the developing roller 36 than in the first supply bias mode.

The bias applying unit 103 applies, to the supply roller 38, a voltage higher than to the developing roller 36, for moving the toner more readily from the supply roller 38 to the developing roller 36. The toner can readily move when the potential decreases from the supply roller 38 toward the developing roller 36, and the toner is positively charged. If the supply roller 38 is applied a voltage higher than that of the developing roller 36 even in the first supply bias mode, the supply roller 38 should be applied, in the second supply bias mode, a voltage higher than that in the first supply bias mode.

The toner may be negatively charged. In this case, the supply roller 38 may be applied a voltage lower than the developing roller 36 for moving readily the toner from the supply roller 38 to the developing roller 36.

In the first supply bias mode, the bias applying unit 103 may apply 0[V] as first voltage between the developing roller 36 and the supply roller 38. That is, the first and second voltage may any values, even if the second voltage is set for moving the toner from the supply roller 38 to the developing roller 36 more readily than the first voltage.

In the first supply bias mode, the second voltage may be set to 0 [V] if the developing roller 36 is applied a voltage higher than the supply roller 38.

Figure 4A:
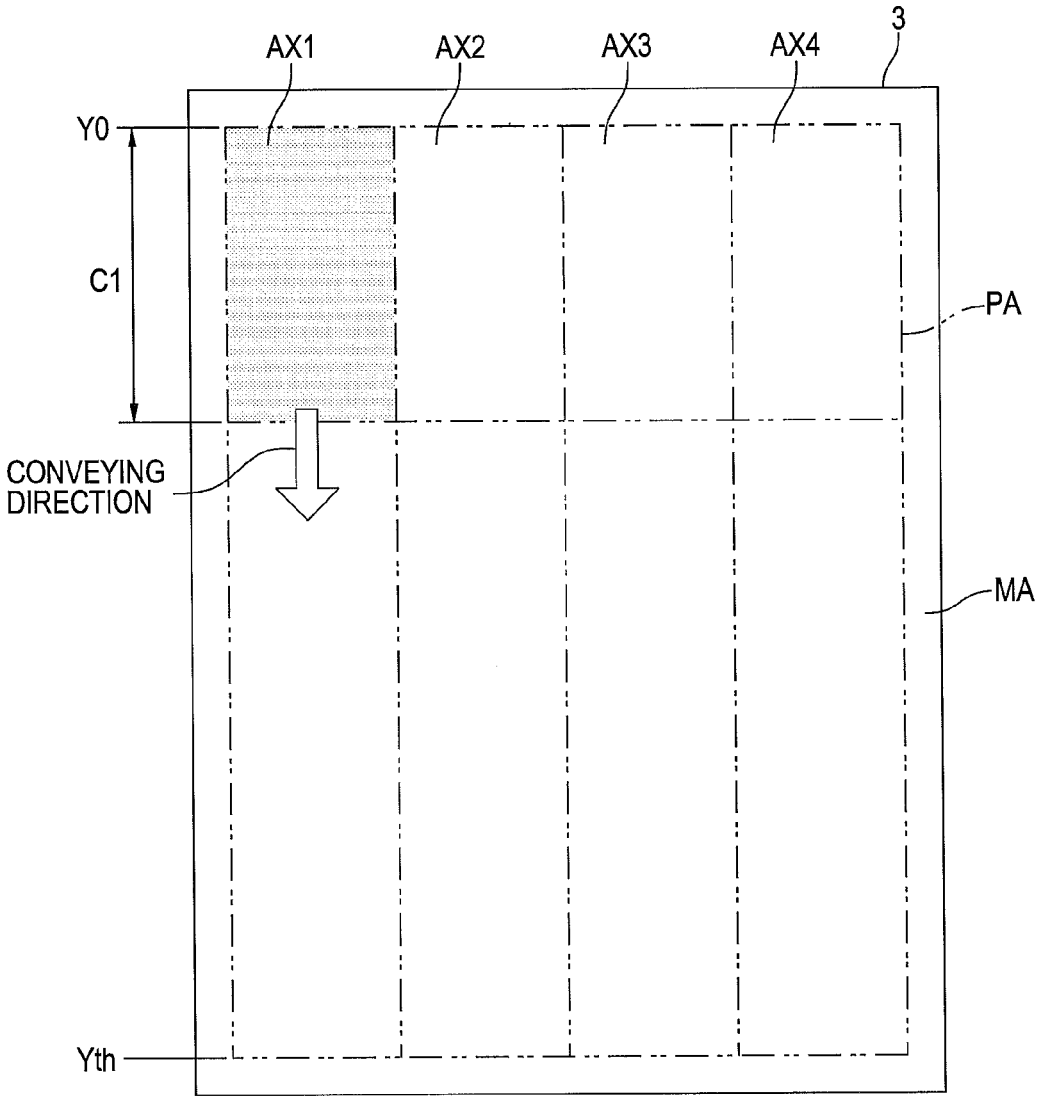
FIG. 4A is a diagram showing a recording sheet in which image data will be printed.
Figure 4B:
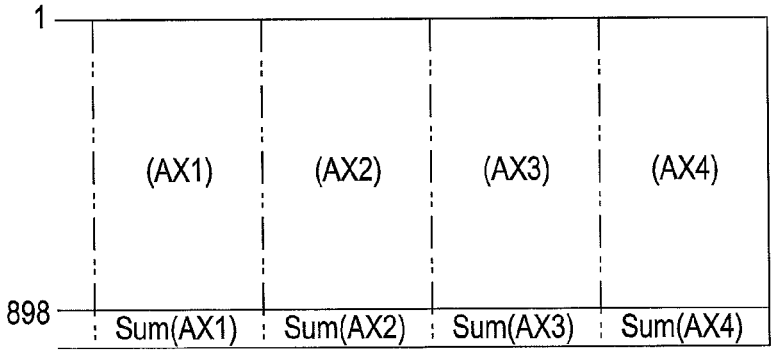
FIG. 4B is a diagram illustrating a storage area for using during an image determining process.

Next, a method for controlling the printing unit 120 by the controller 100 will be explained with reference to FIGS. 4-7. In FIGS. 4A and 4B, a main-scanning direction is an orthogonal direction to a conveying direction in which the recording sheet 3 is conveyed, and is identical to a widthwise direction of recording sheet 3 and an axial direction of the photosensitive drum 32. In other words, the main-scanning direction is identical to the direction in which the surface of the photosensitive drum 32 is scanned with a laser beam. A sub-scanning direction is an orthogonal direction to the main-scanning direction, and is the conveying direction of recording sheet 3 shown by an arrow in FIG. 4A. The main-scanning direction and sub-scanning direction for the image to be printed correspond to the main-scanning direction and sub-scanning direction for the recording sheet 3, respectively. The recording sheet 3 has a margin area MA and a printing area PA as one-printing page. The margin area MA surrounds the printing area PA and corresponds to an area in which no data is to be printed.

The image determining unit 101 divides, in the main-scanning direction, the printing area PA into four sub-printing areas AX1, AX2, AX3 and AX4. Each sub-printing area has a determining area having a length C1 measured from position Y0, to all pixel positions available over the length C1. The image determining unit 101 determines whether the image data includes a part having density greater than or equal to a prescribed density. Specifically, the image determining unit 101 determines, each sample part, whether a ratio of pixels to be printed to total pixel positions available in the subject sample part is greater than or equal to a prescribed ratio. More precisely, the image determining unit 101 determines whether a ratio of pixels to be exist at a sample part of the image data corresponding to each determining area is greater than or equal to the prescribed ratio. For example, the image determining unit 101 determines whether the sample part of image data corresponding to the determining area have density greater than or equal to a preset density, the determining area which has length C1 measured from position Y0 in the sub-printing area AX1. The sample part used to determine type of image at once corresponds to a hatched area shown in FIG. 4A. The controller 100 selects a desirable supply bias mode for one page data in accordance with the determination result of the sample parts determined sequentially along the sub-scanning direction.

In the first embodiment, the length C1 is equivalent to entire outer-circumference-length of the developing roller 36. The number of pixels "DL" corresponding to the length "C1" on the recording sheet 3 can be given from outer-circumference-length "L", print resolution "PR", rotation speed "Sp" and "Sd" of the photosensitive drum 32 and the developing roller 36 respectively as follows:

$$DL(\text{dots})=PR(\text{dpi})\times L(\text{inch})\times Sp(\text{rpm})\div Sd(\text{rpm})$$

In this embodiment, when the resolution is 600 (dpi), the number DL corresponding to the length C1 is 898 (dots).

The length C1 is set equivalent to entire circumference-length of the developing roller 36, because the inventors found that uneven density occurs if an image includes a filled image longer than a prescribed length in the sub-scanning direction. The filled image is image filled with a certain pattern or with one color. As the cause is closely investigated, if the image data has a high density, the toner moves in a large amount to the photosensitive drum 32 from the developing roller 36. When a part of the photosensitive drum 32, which holds a large amount of toner, comes to face again the supply roller 38, the toner must be supplied in a large amount from the supply roller 38 to the developing roller 36. In other words, the developing roller 36 must hold at all times much toner that should be supplied to the photosensitive drum 32. Hence, toner must be readily moved from the supply roller 38 to the developing roller 36 if a high-density printed area extends longer than entire outer-circumference-length of the developing roller 36.

In view of the above, the length C1 can be equivalent to the entire outer circumference of the supply roller 38. If the toner moves in a large amount from the supply roller 38 to the developing roller 36, the toner on the supply roller 38 will likely decrease in amount. It is possible to suppress the decrease in the printing density, by providing a condition that enables the toner to move more readily to the developing roller 36.

FIG. 4B shows a determining buffer that is provided in the RAM 111 and stores a part of image data (determining data) for use in determining the type of image data. The determining buffer includes, for each of the sub-printing areas AX1 to AX4, a storage area that can store the sample part for a distance equivalent to 898 pixels in the sub-scanning direction. If the resolution is set to 600 dpi and if the recording sheet 3 is a letter-size sheet, the number of pixels arranged in the main-scanning direction (i.e., total number of pixels arranged in the horizontal direction for all sub-printing areas AX1 to AX4) is 5100 pixels. Thus, the four storage areas can store 5100×898 pixels. Note that the numbers appended, at a left part in FIG. 4B, indicates number "n" of lines in the determining buffer. Further, the each storage area includes a dot count area Sum(AXn). Each of the dot count areas Sum (AXn) stores the number of pixels existing at the nth line at the sample part. If the image is a monochromic one, the dot count area Sum(AXn) stores number of black pixels in the sample part.

Figure 5:
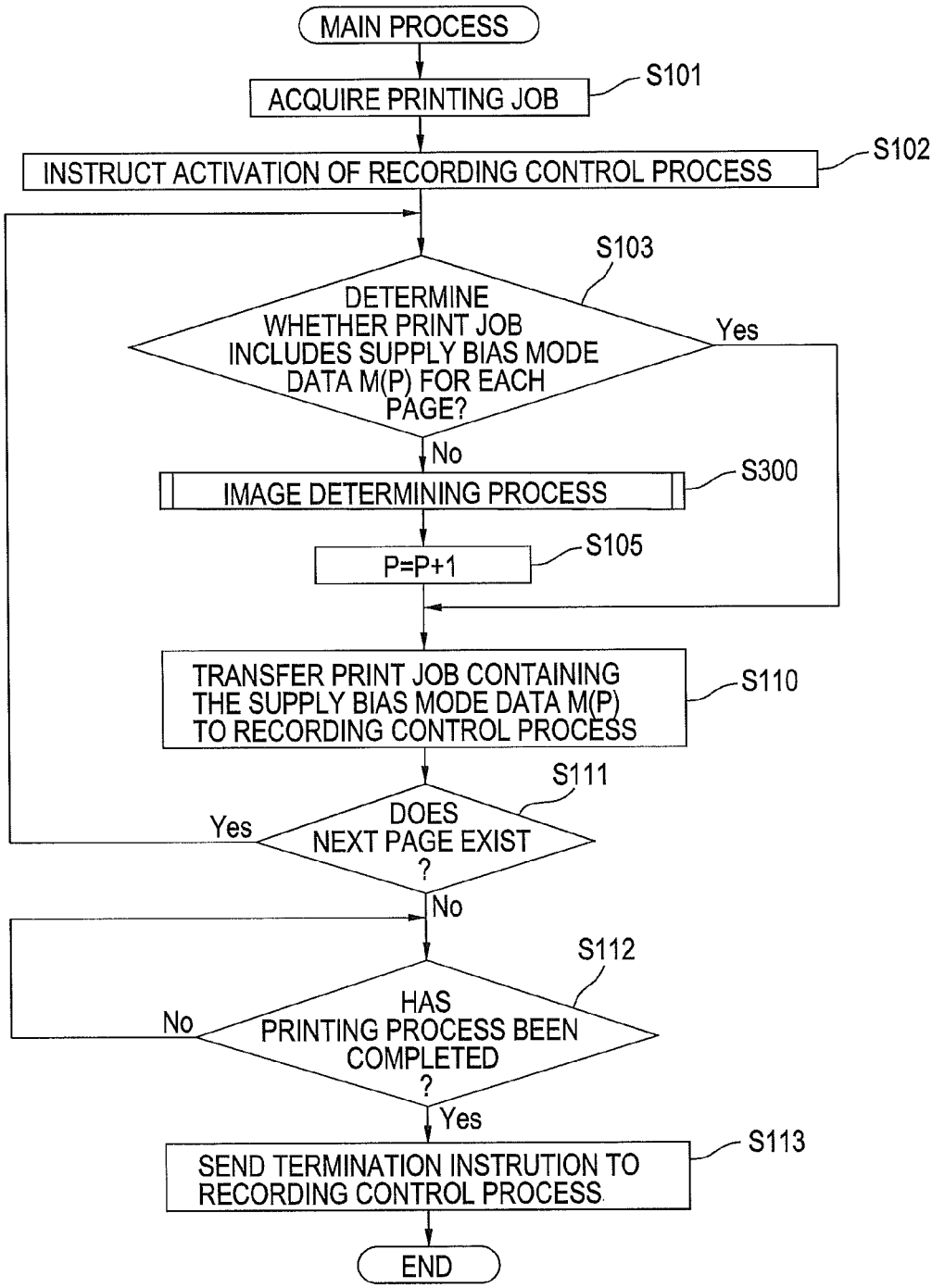
FIG. 5 is a flowchart explaining a main process according to the first embodiment.
Figure 6:
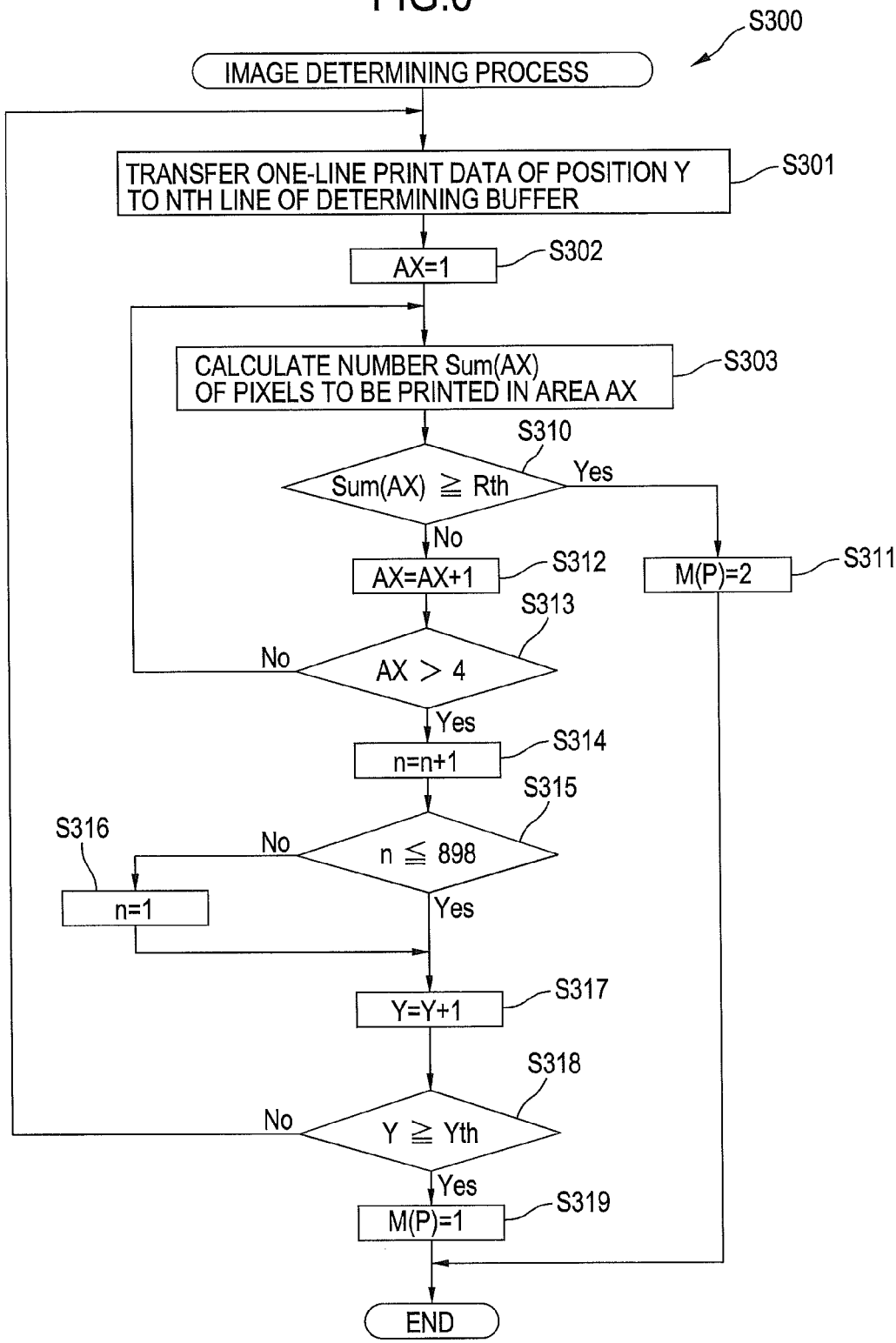
FIG. 6 is a flowchart explaining an image determining process according to the first embodiment.
Figure 7:
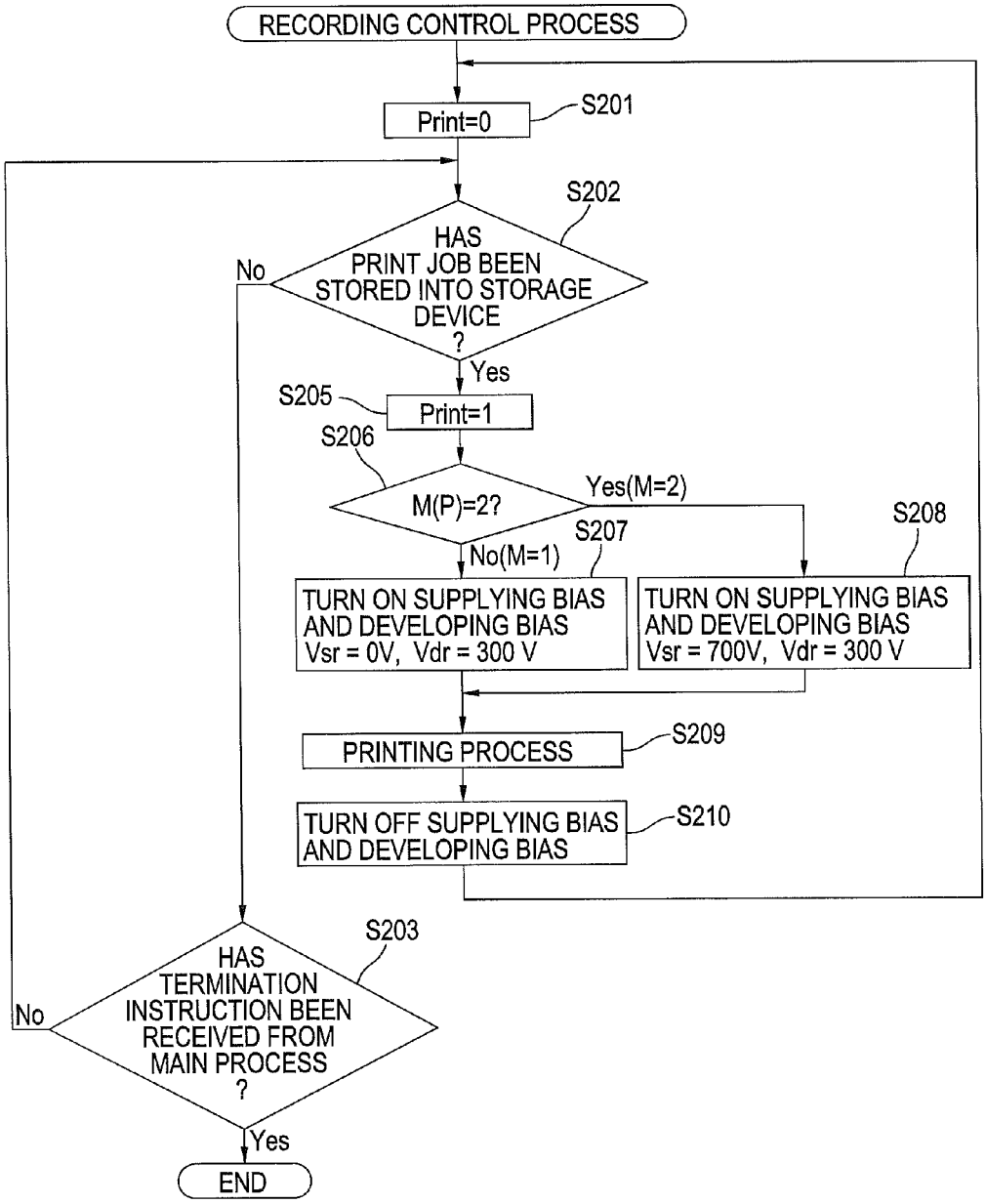
FIG. 7 is a flowchart explaining a recording control process according to the first embodiment.

A main process will be explained with reference to FIGS. 5-7. The process shown in FIGS. 5-7 is performed by the CPU 110 (FIG. 3) by executing the program stored in the ROM 112. In the flowcharts of FIGS. 5-7, "Y" is a line number at the one page image in the sub-scanning direction shown in FIG. 4A, "n" is a position in the determining buffer, "P" is page number, and "M(P)" is a supply bias mode data for the page corresponding to number P. The number "n" corresponds to position Y in the sub-scanning direction at the print area PA, when Y=n+898×a (a=0, 1, 2 . . . ). When M(10) is 1 and 2, M(10) denotes that the supply bias for page 10 of the image data is set to the first supply bias mode and to the second supply bias mode, respectively. The CPU 110 initializes the position Y, the supply bias mode data M, and the page number P are set to initial values, i.e., 0, 1 and 1, respectively before starting the main process.

As shown in FIG. 5, in S101 as a beginning step of the main process, the CPU 110 first acquires a print job from the PC 200. Then, the CPU 110 instructs the activation of a recording control process described later (S102). The recording control process is a process for controlling the transport of the recording sheet 3 and the voltage between the developing roller 36 and supply roller 38. The recording control process is performed independently from the main process.

Next, the CPU 110 determines whether the print job includes the supply bias mode M(P) for each page corresponding to the page number P (S103). If the print job includes the supply bias mode data M(P), as a determination result, determined by PC 200 (S103: Yes), the CPU 110 skips an image determining process of S300 described later and advances to S110. On the other hand, if the print job does not include the supply bias mode data M(P) (S103: NO), the CPU 110 performs the image determining process described later (S300).

After the image determining process is performed, the CPU 110 increases the page number P to be determined by one (S105). In S110, the CPU 110 stores the print job containing the supply bias mode data M(P) in the RAM 111. In other words, the main process transfers the print job containing the supply bias mode data M(P) to the recording control process described later.

After transferring the print job to the recording control process, the CPU 110 determines whether the next page exists in S111. If the next page exists (S111: Yes), the CPU 110 returns to S103. If the next page does not exist (S111: No), the CPU 110 determines whether the printing process has been completed (S112). More precisely, the CPU 110 determines whether a flag is 0 or not (1). The flag indicates whether data is being printed or not. The flag is 0 indicating that the printing process has not been performed, and 1 indicating that the printing process is performed. If the printing process has not been completed (S112: No), the CPU 110 waits for the completion of printing process. If the printing process has been completed (S112: Yes), the CPU 110 instructs the termination of the recording control process (S113) and ends the main process.

Next, the image determining process of S300 will be described with reference to FIG. 7. In the image determining process, the CPU 110 first transfers and stores, to corresponding nth line of the determining buffer, one-line image data for the position Y (=n+898×a) (S301). For example, when the CPU 110 determines the image at the first time, the CPU 110 transfers, to the first line of determining buffer, the print job representing the uppermost line (first line) in the image data for one page. In 5302, the CPU 110 sets a variable number AX to 1. The variable number 1, 2, 3, or 4 is a value representing that the sample part corresponds to the determining area belonging to the sub-printing areas AX1, AX2, AX3, or AX4, respectively. In S303, the CPU 110 calculates the number Sum(AX) of pixels to be printed in the sample part corresponding to the determining area of sub-printing area AX, and stores the number Sum(AX) in the associated area provided in the determining buffer shown in FIG. 4B.

Next, in S310 the CPU 110 determines whether number Sum(AX) is greater than or equal to a prescribed threshold value Rth. If Sum(AX) is greater than or equal to the threshold value Rth (Sum(AX)≧Rth) (S310: Yes), the CPU 110 sets the supply bias mode M to 2 (S311) and then ends the image determining process. On the other hand, if Sum(AX) is smaller than the threshold value Rth (Sum(AX)<Rth) (S310: No), the CPU 110 increments "AX" by one (S312) and then determines whether AX exceeds 4 (S313).

If AX does not exceed 4 (S313: No), the CPU 110 returns to S303. For example, the CPU 110 calculates and stores the number Sum(AX) for the sub-printing area AX2 in the second loop. On the other hand, if AX exceeds 4, in other words, each sub-printing areas AX1 to AX4 at the position Y has low density (S313: Yes), the CPU 110 increases number "n" by one in order to determine (n+1)th line (S314).

In S315, the CPU 110 determines whether n is smaller than or equal to 898. If n is greater than 898 (S315: No), the CPU 110 sets n to 1 in S316. That is, the destination, to which the next line data should be transferred, is reset to the first line since the storage area has been used to the last line in the determining buffer. If n is smaller than or equal to 898 (S315: Yes), the CPU 110 does not change the value "n" and increases "Y" by one (S317).

The CPU 110 determines whether Y is greater than or equal to a threshold value $Y_{th}$ (S318). If Y is smaller than $Y_{th}$ (S318: No), the CPU 110 returns to S301. Note that $Y_{th}$ is a threshold for Y, which is used to determine whether the entire of one page has undergone the image determining process. As shown in FIG. 4A, $Y_{th}$ is equivalent to the position of the last line in the printing area PA. The CPU 110 sets the threshold value $Y_{th}$ appropriately in accordance with the size of recording sheet 3 designated in the print job.

If Y is greater than or equal to $Y_{th}$, in other words, the entire subject page has low density (S318: Yes), the CPU 110 sets the supply bias mode M(P) to 1 in S319, and then ends the image determining process. The value of the supply bias mode data M(P) is stored for each one page data.

Next, the recording control process will be described with reference to FIG. 7. The recording control process is performed in parallel with the main process of FIG. 5. In S201, the CPU 110 sets the flag to 0. In S202, the CPU 110 determines whether print job has been stored into a storage device (e.g., RAM 111) by the main process shown in FIG. 5. If no print job is stored (S202: No), the CPU 110 determines whether a termination instruction has received from the main process (S203). If a termination instruction has received (S203: Yes), the CPU 110 terminates the recording control process. On the other hand, if no termination instruction has been received (S203: No), the CPU 110 returns to S202.

If print job is stored (S202: Yes), the CPU 110 sets the flag "I" to 1 in S205. In S206, the CPU 110 determines whether the supply bias mode data M(P) is 2 or not (1). If M(P) is 1 (in a first supply bias mode) (S206: No), the CPU 110 instructs the bias applying unit 103 to turn on (apply) the supplying bias and the developing bias, setting supply voltage Vsr applied to the supply roller to 0 V and developing voltage Vdr applied to the developing roller to 400 V (S207). On the other hand, if M(P) is 2 (in a second supply bias mode)(S206: Yes), the CPU 110 instructs the bias applying unit 103 to turn on the supplying bias and the developing bias, setting the supply voltage Vsr applied to the supply roller to 700 V to 0 V and developing voltage Vdr applied to the developing roller to 400 V (S208). Then, the CPU 110 performs a printing process for one page (S209), and instructs the bias applying unit 103 to turn off the supplying bias and the developing bias (S210). Then, the CPU 110 returns to S201 and repeats the process. Thus, every time when the print job is transferred from the main process, the printing process is performed at the supplying bias in accordance with the supply bias mode data M(P) determined in the control process.

In the first embodiment, the CPU 110 sets the supply bias mode to the second supply bias mode if the ratio of print pixels is greater than or equal to the prescribed value in at least one of the sub-printing areas AX1 to AX4. Accordingly, it is possible to prevent degradation of printing density.

Next, a second embodiment will be described. In the first embodiment, the CPU 110 determines the type of image data by using software (various program executed by CPU 110). In the second embodiment, the print job processing hardware (as ASIC in this embodiment) performs both the image determining process and the printing process at the same time. Note that the ASIC (not shown) is provided in the printing unit 120 shown in FIG. 2. In the second embodiment, the ASIC can perform printing process, as a part of the controller 100. The processes shown in the flowcharts of FIGS. 9B and 10 are performed by the ASIC. The processes shown in the flowcharts of FIGS. 8 and 9A are performed by the CPU 110.

Figure 8:
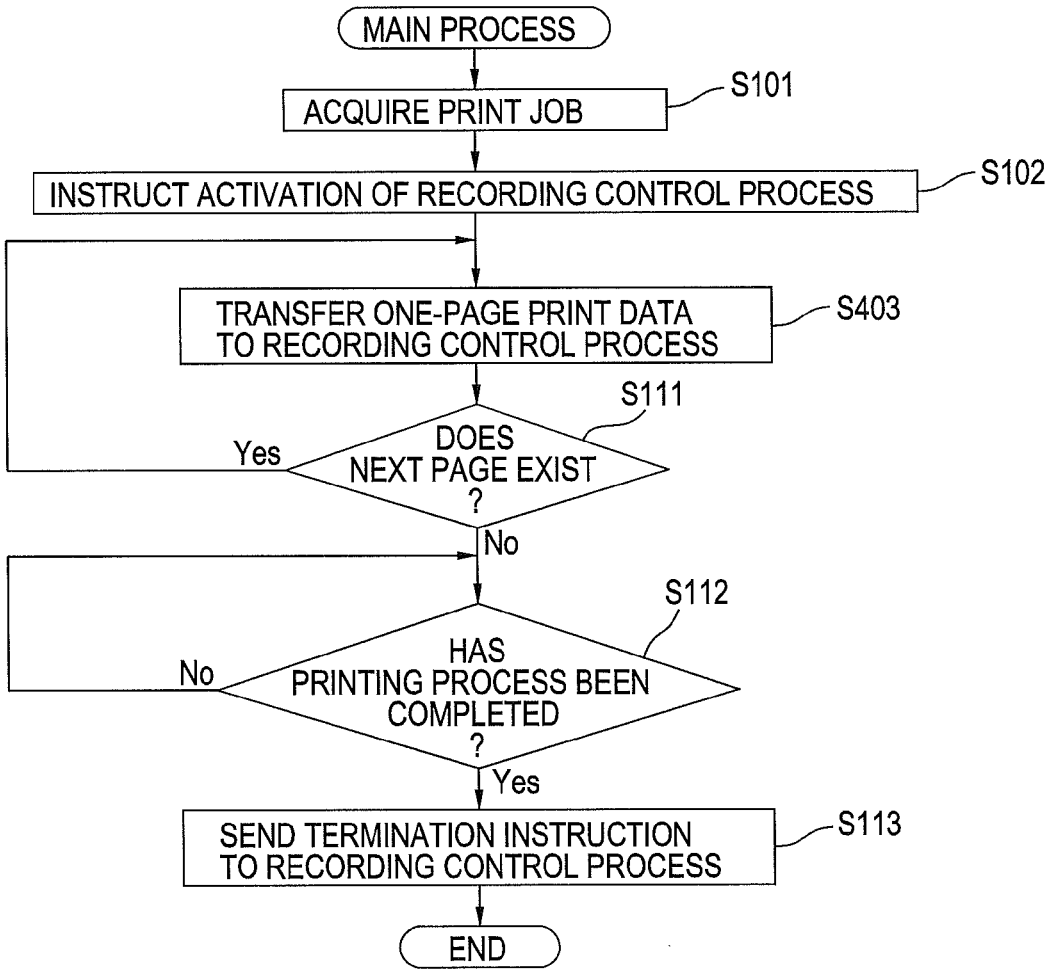
FIG. 8 is flowchart explaining a main process according to a second embodiment.

FIG. 8 is a flowchart of a main process according to the second embodiment. The main process according to the second embodiment has the processes same as that in the first embodiment shown in FIG. 5, wherein is designated by the same step numbers to avoid duplicating description. Thus, only process of S403 will be described. In the main process performed by software, the CPU 110 transfers the image data for one page contained in the print job to the recording control process shown in FIG. 9A (S403), without determining the type of image data represented by the print job in the main process.

Figure 9A:
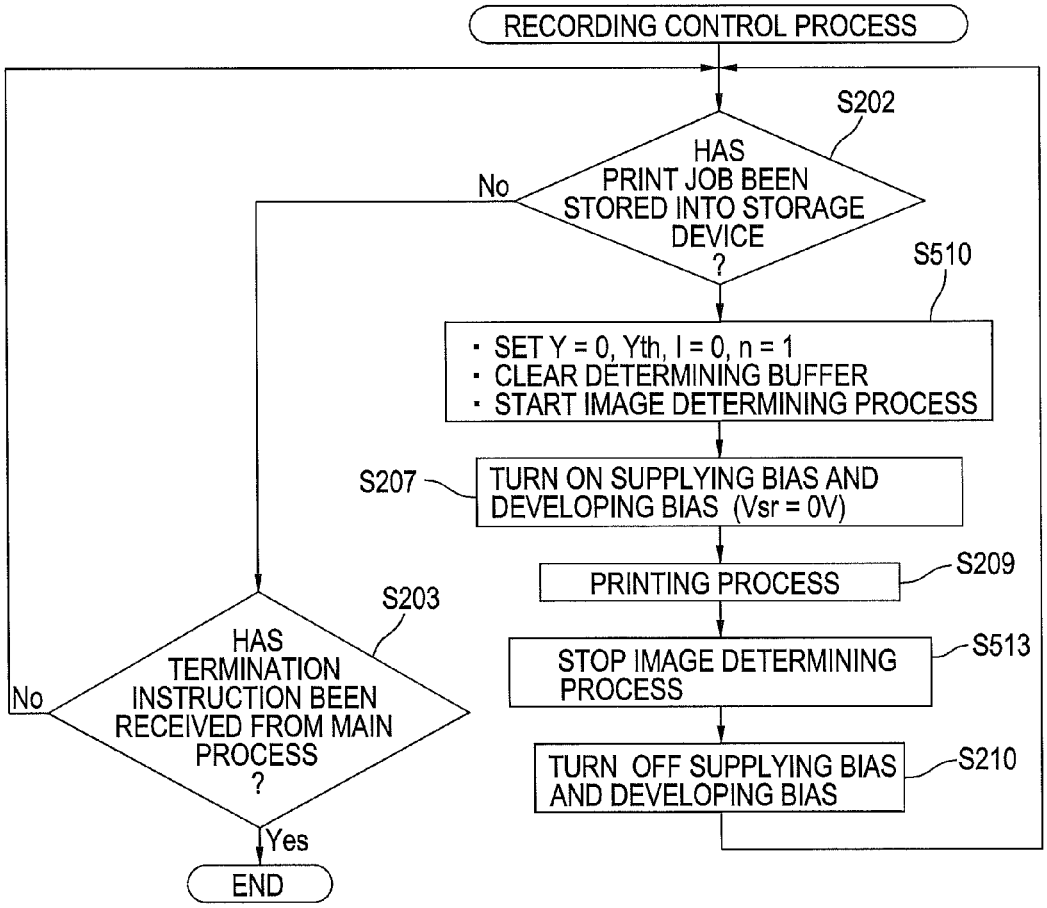
FIG. 9A is a flowchart explaining a recording control process according to the second embodiment.
Figure 9B:
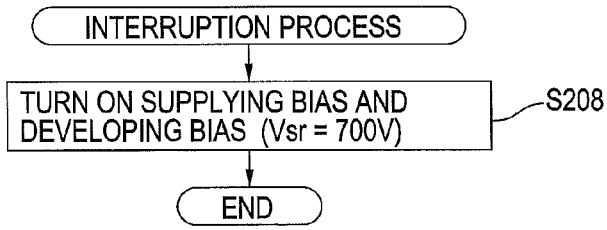
FIG. 9B is a flowchart explaining an interruption process.
Figure 10:
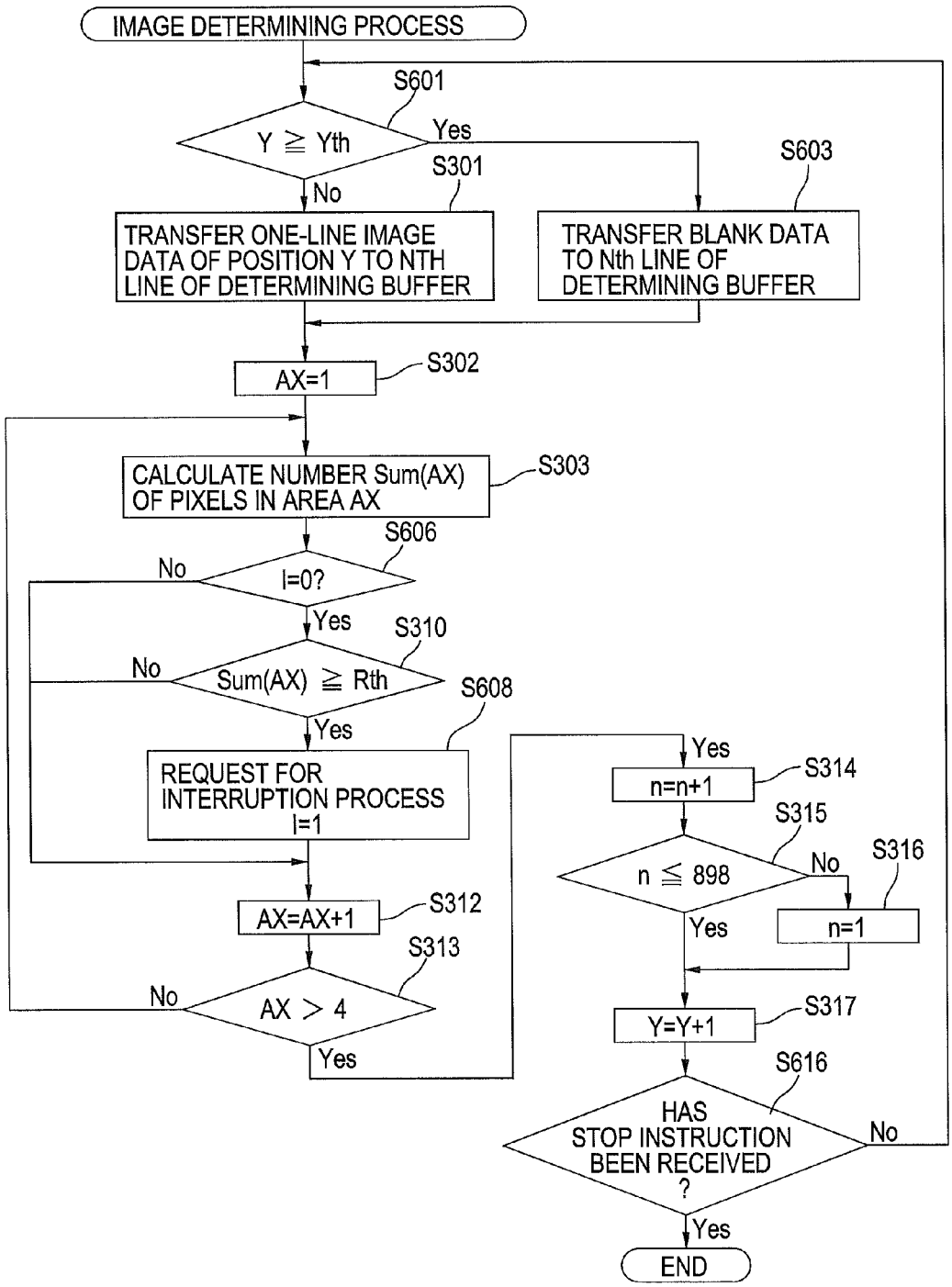
FIG. 10 is a flowchart explaining an image determining process according to the second embodiment.

FIG. 9A is a flowchart of the recording control process according to the second embodiment. The recording control process according to the second embodiment has the same processes of S202, S203, S207, S209, and S210 as that in the first embodiment shown in FIG. 7. Thus, processes of S510 and 513 will be specifically described.

As shown in FIG. 9A, the CPU 110 determines whether the print job has been transferred from the main process (S202). If the print job has not been transferred (S202: No), the CPU 110 determines whether the termination instruction has been generated in the main process (S203). If the termination instruction has been generated in the main process (S203: Yes), the CPU 110 terminates the recording control process.

If print job exists (S202: Yes), the CPU 110 sets the threshold value $Y_{th}$, and initializes Y to 0, flag I to 0, and n to 1, all being the initially set values, and clears the determining buffer (S510). Thereafter, the CPU 110 activates the ASIC for starting the image determining process. Note that the flag I indicates that the ASIC has not performed an interruption process (FIG. 9B) described later when I is 0, and the ASIC has performed an interruption process when I is 1.

Then, the CPU 110 instructs the bias applying unit 103 to turn on the first supplying bias (Vsr=0 [V]) and the developing bias (S207) and performs a printing process (S209). While the CPU 110 is performing the printing process, an interruption process may be performed to set the second supplying bias (Vsr=700 [V]) as requested by the ASIC. The interruption process will be described later.

When the printing process is completed in the recording control process, the CPU 110 stops the image determining process (S513). Then, the CPU 110 instructs the bias applying unit 103 to turn off the supplying bias (S210) and returns to S202.

FIG. 10 is a flowchart of an image determining process according to the second embodiment. The image determining process according to the second embodiment has the same processes of S301-S303, S310, and S312-S317 as that in the first embodiment shown in FIG. 6. Thus, processes of S601, S603, S606, S608, and S616 will be specifically described. If the image data has density greater than or equal to a preset value, the ASIC requests to perform an interruption process shown in FIG. 9B so that the supplying bias may increase (S608). As described above, the image determining process is a part of the printing process performed by the ASIC.

As shown in FIG. 10, the ASIC determines whether Y is greater than or equal to the prescribed value $Y_{th}$ (S601). If the ASIC determines Y is greater than or equal to $Y_{th}$ (S601: Yes), the ASIC writes a blank data representing no print job in the nth line of the determining buffer (S603). On the other hand, if the ASIC determines that Y is smaller than $Y_{th}$ (S601: No), the ASIC transfers one-line image data (line data) to the nth line of the determining buffer (S301). Then, the ASIC sets the variable number AX to 1 (S302). The ASIC calculates and stores the number Sum(AX) in the determining buffer (S303).

Next, in 5606, the ASIC determines whether the flag I is 0 or not (1). If the ASIC determines that I is not 0 (1) (S606: No), the interruption process for the page data has been performed in the printing process instead of S207. That is, the supplying bias Vsr has been set to 700 [V] (S208 in FIG. 9B). Hence, the ASIC advances to S312. If the ASIC determines that I is 0 (S606: Yes), the ASIC determines whether Sum (AX) is greater than or equal to the threshold value $R_{th}$ (S310). If Sum(AX) is greater than or equal to the threshold value $R_{th}$ (Sum(AX)≧Rth), in other words, the ratio of print pixels is high (S310: Yes), the ASIC requests for the interruption process for switching the supply bias mode to the second supplying bias (S608). When the ASIC sends a request for the interruption process, the ASIC sets the supplying bias Vsr to 700 V in S208 as shown in FIG. 9B. After the ASIC ends the interruption process of FIG. 9B, the ASIC sets I to 1 (S608).

On the other hand, if Sum(AX) is smaller than the value Rth (Sum(AX)<Rth) (S310: No), the ASIC advances to S312. The processes of S312-S317 performed by the ASIC is same as that performed by the CPU 110 in the image determining process according to the first embodiment (see FIG. 6).

Then, the ASIC determines whether a stop instruction has been received from the main process in S616. If a stop instruction has been received (S616: Yes), the ASIC terminates the image determining process. On the other hand, if no stop instruction has been received (S616: No), the ASIC returns to S601.

As described above, the hardware (ASIC) performs the printing process and the image determining process. If the ratio of print pixels is greater than or equal to the prescribed value, the supply bias mode is set to the second supply bias mode (Vsr=700 V). Accordingly, it is possible to prevent degradation of printing density. Further, the hardware (ASIC) performs the image determining process involving a large amount of data in the second embodiment, whereby it is possible to perform the processes quickly. Further, since the print job are sequentially transferred to the hardware (ASIC) as soon as the main process acquires the print job for one page in S403, it is possible to decrease time for waiting for generation of next print job based on the print job. That is, the software (CPU 110) can efficiently perform the process.

Next, a third embodiment of this invention will be described with reference to FIGS. 11 and 12. The third embodiment is different from the second embodiment in that the supplying bias Vsr is changed to various values, between the first supplying bias (0V) and the second supplying bias (700V). The RAM 111 stores a relation (Tup table) that bias level Rp and bias value V when the supplying bias is increased, and a relation (Tdown table) that the bias level Rp and bias value V when the supplying bias is decreased shown in FIG. 12. Both the printing control process and the image determining process performed in the third embodiment are identical to those performed in the second embodiment shown in FIGS. 8-9B. Accordingly, a recording control process in the third embodiment will be described.

Figure 11:
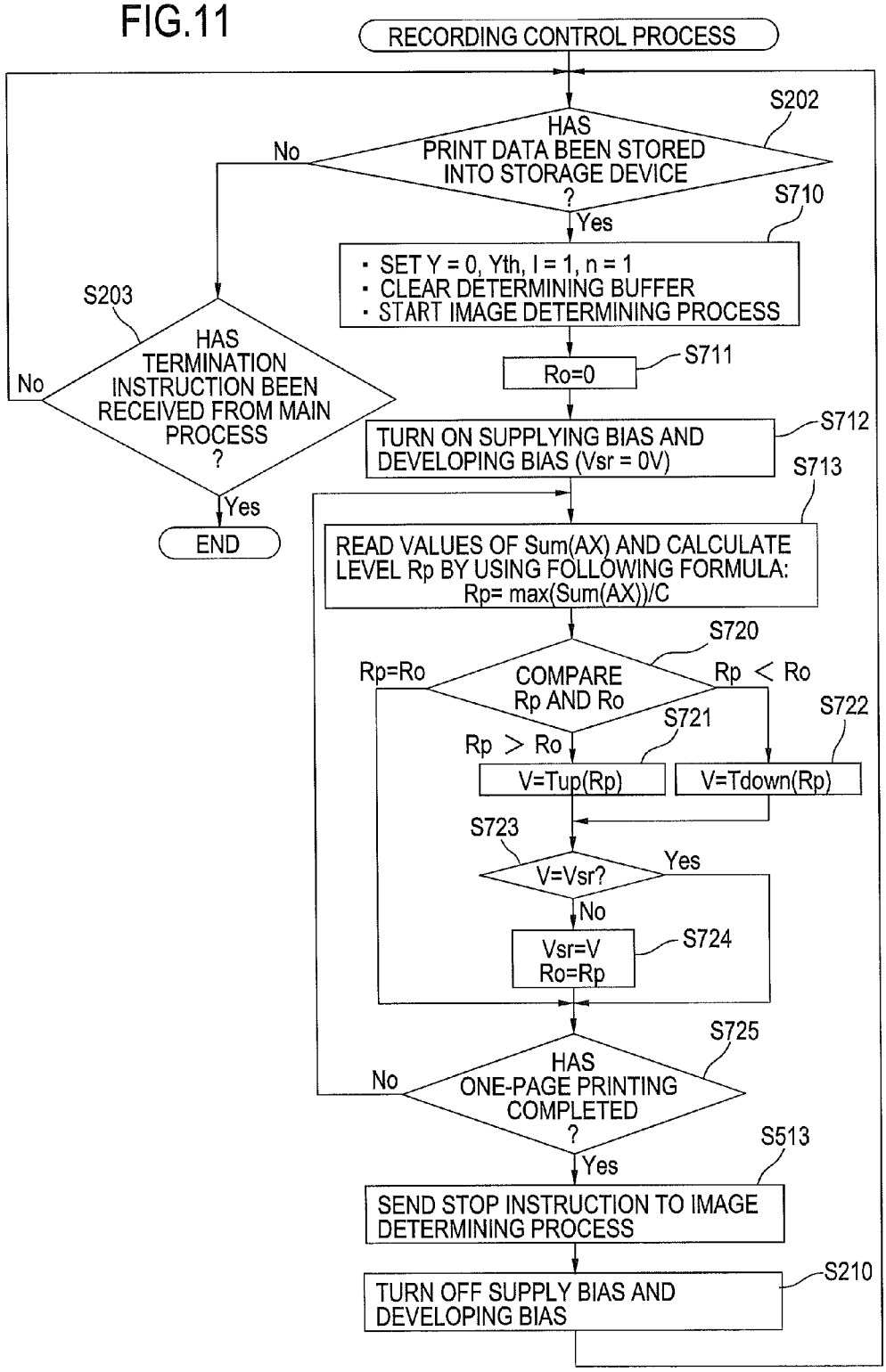
FIG. 11 is a flowchart explaining a recording control process according to a third embodiment.

As shown in FIG. 11, the CPU 110 determines in S202 whether any print job has been transferred from the main process. If no print job has been transferred (S202: No), the CPU 110 determines whether a termination instruction has been received from the main process (S203). If the CPU 110 determines that a termination instruction has not been received (S203: No), the CPU 110 returns to S202. If the CPU 110 determines that a termination instruction has been received (S203: Yes), the CPU 110 terminates the recording control process.

If print job has been transferred from the main process (S701: Yes), the CPU 110 initializes $Y_{th}$, Y to 0, I to 1, and n to 1, clears the determining buffer, and then activates the image determining unit 101 (S710). The CPU 110 further sets the flag I to 1, indicating that an interruption process has come from the ASIC in S710. The supplying bias is changed in the recording control process, not when an interruption process is performed by the ASIC.

In 5711, the CPU 110 sets a previous bias level "Ro" to 0, Ro representing a bias level of the supplying bias set in a previous loop, for the sample part determined in the previous loop and being adjacent to a sample part to be determined in the present loop. Then, the CPU 110 instructs the bias applying unit 103 to turn the supplying bias on, setting the supplying bias Vsr to 0 [V] (first supplying voltage) (S207).

Next, the CPU 110 calculates a present bias level "Rp" of the supplying bias (S713). Specifically, the CPU 110 reads the four values of Sum(AX) for the sample part corresponding to the sub-printing areas AX1 to AX4 that have been sequentially rewritten by the ASIC (see S303 shown in FIG. 10), and determines maximum value max(Sum(AX)) among the Sum (AX) for the sample part. Then, the CPU 110 calculates the bias level Rp by dividing the maximum value max(Sum(AX)) by a coefficient C. Rp is an integral variable, and the coefficient C is a conversion coefficient for changing Sum(AX) to one of ten values, i.e., 0 to 9.

In S720, the CPU 110 compares the present bias level Rp with the previous bias level Ro. If Rp is greater than Ro, in other words, the ratio of print pixels tends to be high (S270: Rp>Ro), the CPU 110 acquires a bias value "V" corresponding to Rp by referring to the Tup table shown in FIG. 12 (S721). On the other hand, if Rp is smaller than Ro, in other words, the ratio of print pixels tends to be low (S270: Rp<Ro), the CPU 110 acquires the bias value "V" corresponding to Rp by referring to the Tdown table shown in FIG. 12 (S722). If Rp is equal to Ro (S270: Rp=Ro), the CPU 110 advances to S725 without changing the bias value V.

In S723, the CPU 110 compares the bias value "V" acquired with the supplying bias Vsr, and determines whether V is equal to Vsr. If the CPU 110 determines that V is equal to Vsr (S723: Yes), the CPU 110 advances to S725 without changing the supplying bias Vsr and the previous bias level Ro. If the CPU 110 determines that V is not equal to Vsr (S723: No), the CPU 110 substitutes V into Vsr, and Rp into Ro (S724). That is, the CPU 110 changes the supplying bias "Vsr", and updates the previous level "Ro" to the present bias level "Rp" in S724.

In S725, the CPU 110 determines whether the printing process for one page has completed or not. If the printing process for one page has not been completed (S725: No), the CPU 110 returns to S713 and repeatedly changes the supplying bias Vsr in accordance with the ratio of print pixels. On the other hand, if the printing process for one page has been completed (S725: Yes), the CPU 110 sends a stop instruction to the image determining process (S513). The CPU 110 then turns off the supplying bias (S210).

In the recording control process according to the third embodiment, the CPU 110 changes, during the printing process for one page, the first supply bias mode from the first supply bias mode to the second supply bias mode if the ratio of print pixels is equal to or lower than the prescribed value. Accordingly, it is possible to prevent degradation of printing density. Further, it is also possible to prevent abruptly changing density of image, because the supplying bias is gradually increased or decreased.

Moreover, in the third embodiment, the CPU 110 acquires the bias value "V" corresponding to the present bias level "Rp" by referring to the two tables as shown in FIG. 12, the Tup table referred when the supplying bias is increased (when the ratio of print pixels increases), and the Tdown table referred when the supplying bias is decreased (when the ratio of print pixels decreases). The Tup table has greater number of present bias levels Rp corresponding to 0 [V] as the supplying bias V than other levels Rp corresponding to other supplying bias. On other hands, the Tdown table has greater number of levels Rp corresponding to 700 [V] as the supplying bias V than present bias levels Rp corresponding to other supplying bias. Therefore, once set to the first supplying bias or the second supplying bias, the supplying bias will not immediately change when the ratio of print pixels fluctuates a little. Accordingly, it is possible to prevent the supplying bias Vsr from changing unnecessarily even if the ratio of print pixels varies a little. That is, unnecessary fluctuation of printing density can be eliminated.

Next, a fourth embodiment will be described with reference to FIG. 13. The main process and recording control process according to the fourth embodiment is same as that according to the first embodiment. An image determining process according to the fourth embodiment is different from that in the first embodiment. The image determining process will be described with reference to FIG. 13.

In the fourth embodiment, the print job transferred from the PC 200 is data structure similar to device context rather than image data of dot-matrix type. The device context includes instruction designating an image to be printed on a page, for example, as "black image printed in a designated area" and "text printed at a designated position."

Figure 13:
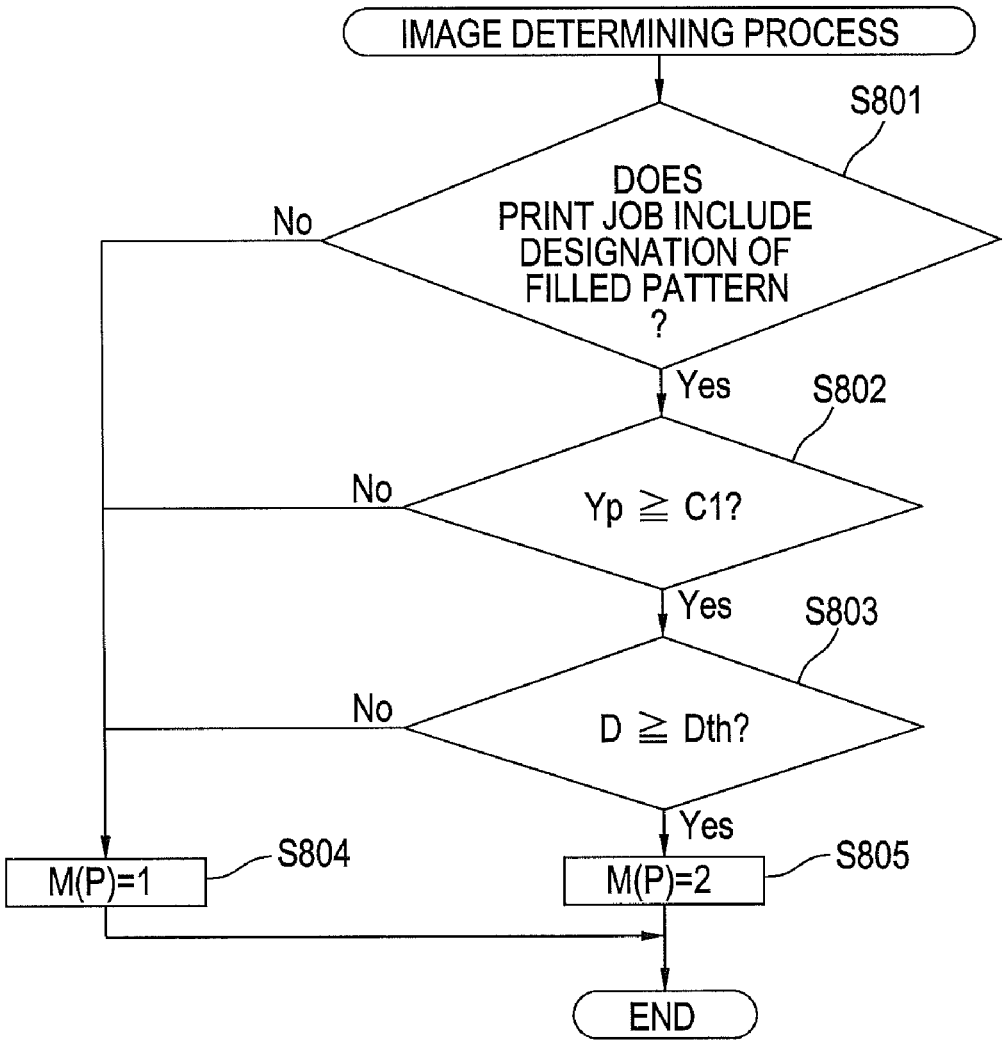
FIG. 13 is a flowchart explaining a recording control process according to a fourth embodiment.

In the image determining process in FIG. 13, the CPU 110 first determines whether the print job includes an instruction designating a black pattern (S801). The black pattern includes continuing pixels to be printed consecutively. If the CPU 110 determines that print job does not include an instruction designating a black pattern (S801: No), the CPU 110 sets the supply bias mode M(P) to 1 (S804).

If the print job includes an instruction designating a black pattern (S801: Yes), the CPU 110 determines whether the black pattern has a size value "Yp" measured in the sub-scanning direction is larger than or equal to the prescribed length C1 (S802). If the CPU 110 determines that Yp is shorter than C1 (S802: No), the CPU 110 sets the supply bias data M(P) to 1 (S804).

If the CPU 110 determines that Yp is larger than or equal to C1 (S802: Yes), the CPU 110 determines whether density "D" set for the black pattern is higher than or equal to a prescribed threshold value $D_{th}$ (S803).

If the CPU 110 determines that D is lower than $D_{th}$ (S803: No), the CPU 110 sets the supply bias data M(P) to 1 (S804). If the CPU 110 determines that D is higher than or equal to $D_{th}$ (S803: Yes), the CPU 110 sets the supply bias mode data M(P) to 2 (S805).

In the image determining process according to the fourth embodiment, the CPU 110 sets the second supply bias mode (M(P)=2) when the print job includes a specific black pattern, the black pattern having a size in the sub-scanning direction larger than the prescribed size, and having a density higher than the threshold density. Accordingly, it is possible to prevent degradation of printing density by performing a simple determining method.

While the invention has been described in detail with reference to the embodiments thereof, it would be apparent to those skilled in the art that various changes and modifications may be made therein without departing from the spirit of the invention.

In the first embodiment described above, the one page is divided into the four areas for determining the ratio of pixels in the main-scanning direction. Instead, the one page may be divided into a plurality of area corresponding to each row of pixels, i.e., each line spaced part from any adjacent line in the sub-scanning direction. Because the human eye can not recognize image that has uneven density and has no relatively large size, image data for one page should better be determined for each of the areas divided in the main-scanning direction rather than line by line.

In the fourth embodiment, the CPU 110 determines whether the density designated for a specific pattern, such as a filling image in black, exceeds a prescribed threshold value. Instead, the CPU 110 may determine whether identical text characters are continuously arranged in the sub-scanning direction, for a distance longer than a threshold value.

Alternatively, dot-matrix image data may be divided into a plurality of pixel blocks, for example, pixel block including 8×8 pixel block. In the case, the CPU 110 may determine whether these pixel blocks are identical in terms of pattern of the divided block though a great amount of data must be processed. Accordingly, the CPU 110 can determine whether identical patterns are arranged in the sub-scanning direction for a prescribed distance.

Figure 14:
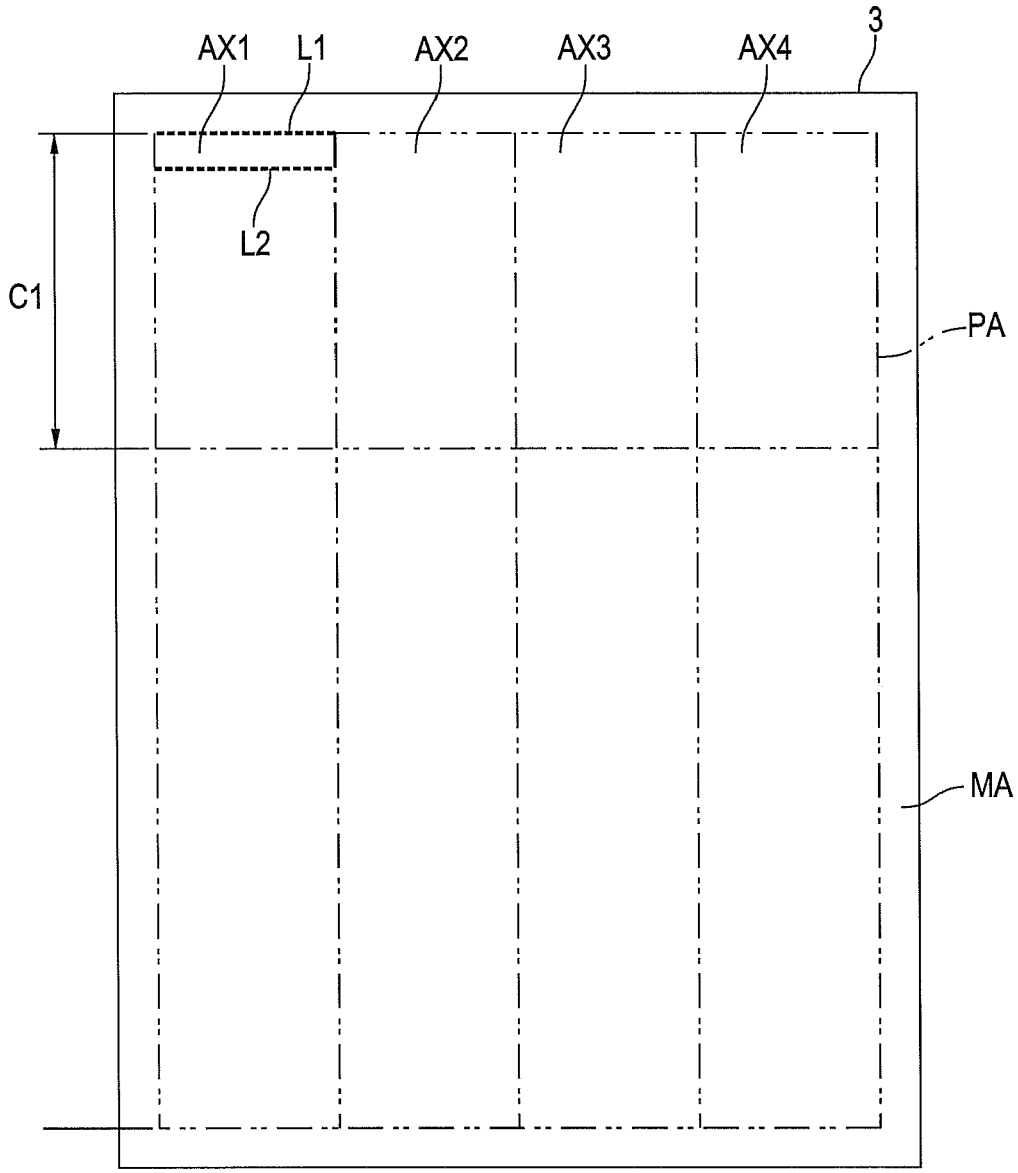
FIG. 14 is a diagram explaining another method for determining whether image data includes a specific pattern.

Further, another method for determining whether identical patterns are arranged will be described with reference to FIG. 14. As shown in FIG. 14, when the dot-matrix image data is input to the controller 100, the CPU 110 may compare the image data corresponding to the first line L1 of the area AX1 with that of the second line downstream of the first line L1 in the sub-scanning direction, with that of third line, with that of forth line, and with that of fifth line immediately. For example, when the pattern of image data corresponding to first line L1 is identical to that corresponding to the fifth line L2, the CPU may determine whether same line pattern is formed, at five lines, within the sample part corresponding to length C1 in the area AX1, for determining whether identical patterns are continuously arranged in the sub-scanning direction.

In the embodiments described above, monochrome laser printer is provided as an example of device applied the present invention, but the present invention can be applied to color printer. In this case, the CPU may determine, each color of toners, whether print pixels are arranged in the sub-scanning direction at a ratio higher than or equal to a prescribed ratio. Further, a printer in which the photosensitive drum is exposed to LED beams may be provided. Moreover, since this invention is not limited to printers, the invention can be applied to other types of image forming apparatuses such as copiers and multi-function peripheries.

Further, the present invention can be reduced to practice, in the form of a computer program for use in computers that serve to form images. That is, a printer driver installed in a computer may cause the computer to determine the type of any image to be formed and to instruct the components to form images in the first or second supply bias mode.

What is claimed is:

1. An image-forming device comprising:

an image acquiring unit configured to acquire image data representing an image for one page, the image having a page length in a first direction, the image including a plurality of lines arranged in the first direction, each line including a plurality of pixels arranged in a second direction orthogonal to the first direction, the image data including a plurality of sets of line data, each set of line data indicating one of the plurality of lines and including a plurality of sets of pixel data, each set of pixel data indicating one of the plurality of pixels;

an image forming unit configured to form an image based on the image data, the image forming unit including:

a developing roller configured to carry a developer;

a supply roller configured to supply the developer to the developing roller; and a bias applying unit configured to apply a first voltage between the developing roller and the supply roller in a first mode, and to apply a second voltage between the developing roller and the supply roller in a second mode;

a line data setting unit configured to set at least two sets of consecutive line data among the plurality sets of line data as determined line data, the determined line data corresponding to an area having at least two consecutive lines, the area having a prescribed length in the first direction, the prescribed length being smaller than the page length;

a determining unit configured to determine whether a ratio of pixels to be printed to total pixels in the area is higher than or equal to a prescribed ratio based on the determined line data;

a controller configured to control the bias applying unit to apply the first voltage when the determining unit determines that the ratio is lower than the prescribed value, the controller controlling the bias applying unit to apply the second voltage when the determining unit determines that the ratio is higher than or equal to the prescribed ratio; and an updating unit configured to repeatedly update the determined line data by one line, and wherein, when the updating unit updates the determined line data, the determining unit determines whether the ratio is higher than or equal to the prescribed ratio based on the updated determined line data.

2. The image forming device according to claim 1, wherein the developer is positively charged, and wherein the bias applying unit comprises:

a supply voltage applying unit configured to apply a first supply voltage to the supply roller in the first mode, the supply voltage applying unit applying a second supply voltage to the supply roller in the second mode, the second supply voltage being greater than the first supply voltage; and a developing voltage applying unit configured to apply a developing voltage to the developing roller smaller than or equal to the first supply voltage.

3. The image forming device according to claim 1, wherein the developer is negatively charged, and wherein the bias applying unit comprises:

a supply voltage applying unit configured to apply a first supply voltage to the supply roller in the first mode, the supply voltage applying unit applying a second supply voltage to the supply roller in the second mode, the second supply voltage being smaller than the first supply voltage; and a developing voltage applying unit configured to apply a developing voltage greater than or equal to the first supply voltage to the developing roller.

4. The image forming device according to claim 1, wherein the prescribed length is equal to the entire outer-circumference-length of the developing roller.

5. The image forming device according to claim 1, wherein the prescribed length is equal to the entire outer-circumference-length of the supply roller.

6. The image forming device according to claim 1, further comprising a dividing unit configured to divide the determined line data into a plurality of sets of determined area data in the second direction, and wherein the determining unit determines that the ratio of pixels to be printed to total pixels contained in the area is higher than or equal to the prescribed ratio when a ratio of pixels to be printed to total pixels contained in a determined area is higher than or equal to the prescribed ratio based on the determined area data set.

7. The image forming device according to claim 1, wherein the bias applying unit further applies a third voltage between the developing roller and the supply roller, the third voltage being an intermediate voltage between the first voltage and the second voltage, wherein the updating unit updates the determined line data from previous determined line data to current determined line data, wherein the controller controls the bias applying unit to apply the third voltage between the developing roller and the supply roller when the determining unit determines that the ratio is higher than or equal to the prescribed ratio based on the current determined line data after the determining unit determined that the ratio is lower than the prescribed ratio based on the previous determined line data.

8. The image forming device according to claim 1, wherein the first voltage is zero.

9. An image forming method comprising:

acquiring image data representing an image for one page, the image having a page length in a first direction, the image including a plurality of lines arranged in the first direction, each line including a plurality of pixels arranged in a second direction orthogonal to the first direction, the image data including a plurality of sets of line data, each set of line data indicating one of the plurality of lines and including a plurality of sets of pixel data, each set of pixel data indicating one of the plurality of pixels;

setting at least two sets of consecutive line data among the plurality of sets of line data as determined line data, the determined line data corresponding to an area having at least two consecutive lines, the area having a prescribed length in the first direction, the prescribed length being smaller than the page length;

determining whether a ratio of pixels to be printed to total pixels in the area is higher than or equal to a prescribed ratio based on the determined line data;

controlling a bias applying unit to apply the first voltage between a developing roller and a supply roller when the ratio is lower than the prescribed ratio, and to apply a second voltage between the developing roller and the supply roller when the ratio is higher than or equal to the prescribed ratio, the developing roller carrying a developer, the supply roller supplying the developer to the developing roller;

updating the determined line data by one line; and determining whether the ratio is higher than or equal to the prescribed ratio based on the updated determined line data.

10. A non-transitory computer-readable recording medium that stores an image forming program, the image forming program comprising instructions for:

acquiring image data representing an image for one page, the image having a page length in a first direction, the image including a plurality of lines arranged in the first direction, each line including a plurality of pixels arranged in a second direction orthogonal to the first direction, the image data including a plurality of sets of line data, each set of line data indicating one of the plurality of lines and including a plurality of sets of pixel data, each set of pixel data indicating one of the plurality of pixels;

setting at least two sets of consecutive line data among the plurality sets of line data as determined line data, the determined line data corresponding to an area having at least two consecutive lines, the area having a prescribed length in the first direction, the prescribed length being smaller than the page length;

determining whether a ratio of pixels to be printed to total pixels in the area is higher than or equal to a prescribed ratio based on the determined line data;

controlling a bias applying unit to apply the first voltage between a developing roller and a supply roller when the ratio is lower than the prescribed ratio, and to apply a second voltage between the developing roller and the supply roller when the ratio is higher than or equal to the prescribed ratio, the developing roller carrying a developer, the supply roller supplying the developer to the developing roller;

updating the determined line data by one line; and determining whether the ratio is higher than or equal to the prescribed ratio based on the updated determined line data.

* * * * *